US011598511B2

(12) United States Patent
Cao et al.

(10) Patent No.: US 11,598,511 B2
(45) Date of Patent: Mar. 7, 2023

(54) LIGHTING APPARATUS

(71) Applicant: XIAMEN LEEDARSON LIGHTING CO.,LTD, Fujian (CN)

(72) Inventors: Liangliang Cao, Fujian (CN); Xiaobo Chen, Fujian (CN); Mingyan Fu, Fujian (CN); Liping Lin, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/183,119

(22) Filed: Feb. 23, 2021

(65) Prior Publication Data

US 2021/0270449 A1 Sep. 2, 2021

(30) Foreign Application Priority Data

Feb. 28, 2020 (CN) ..... 202020231492.6

(51) Int. Cl.

| | |
|---|---|
| ***F21V 17/08*** | (2006.01) |
| ***F21V 21/03*** | (2006.01) |
| ***F21Y 115/10*** | (2016.01) |
| ***F21V 23/04*** | (2006.01) |

(52) U.S. Cl.

CPC ..... *F21V 17/08* (2013.01); *F21V 21/03* (2013.01); *F21V 23/045* (2013.01); *F21Y 2115/10* (2016.08)

(58) Field of Classification Search

CPC ..... F21V 21/03; F21V 17/08

See application file for complete search history.

(56) References Cited

U.S. PATENT DOCUMENTS

| | | | | |
|---|---|---|---|---|
| 2011/0074271 | A1* | 3/2011 | Takeshi | F21V 19/0055 313/46 |
| 2016/0230973 | A1* | 8/2016 | Shaw | H02J 7/0047 |
| 2017/0307143 | A1* | 10/2017 | Shah | F21K 9/90 |
| 2018/0091222 | A1* | 3/2018 | Arai | H04B 10/116 |
| 2018/0245780 | A1* | 8/2018 | Okada | F21V 5/045 |
| 2018/0335185 | A1* | 11/2018 | Boulanger | F21S 9/022 |
| 2019/0323691 | A1* | 10/2019 | Winters | F21V 21/04 |

* cited by examiner

*Primary Examiner* — Eric T Eide

(74) *Attorney, Agent, or Firm* — Chun-Ming Shih; Lanway IPR Services

(57) ABSTRACT

A lighting apparatus includes a light source plate, a surface rim and a light passing cover. The light source plate is mounted with a light source. The light source plate is placed upon the support plate. The surface rim has an inner wall and an exterior wall. The inner wall has a top part and a bottom part. A bottom diameter of the bottom part is smaller than a top diameter of the top part. The light source is placed closer to the bottom part of the inner wall and surrounded by the bottom part of the inner wall. The light passing cover is attached to the top part of the inner wall. An exterior edge of the exterior wall is attached to a peripheral edge of the support plate.

18 Claims, 7 Drawing Sheets

LIGHTING APPARATUS

FIELD

The present invention is related to a lighting apparatus, and more particularly related to a lighting apparatus with an easy assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

On designing light devices, cost is a critical factor.

When it is complicated to assemble a light device, the manufacturing cost is kept high. Therefore, it is beneficial to design a light device with easy assembly structures.

Downlight is widely used in various places. It is helpful is a compact design with easy assembly structure may be provided.

SUMMARY

In some embodiments, a lighting apparatus includes a light source plate, a surface rim and a light passing cover.

The light source plate is mounted with a light source.

The light source plate is placed upon the support plate.

The surface rim has an inner wall and an exterior wall.

The inner wall has a top part and a bottom part.

A bottom diameter of the bottom part is smaller than a top diameter of the top part.

The light source is placed closer to the bottom part of the inner wall and surrounded by the bottom part of the inner wall.

The light passing cover is attached to the top part of the inner wall.

An exterior edge of the exterior wall is attached to a peripheral edge of the support plate.

In some embodiments, a driver is also mounted on the light source plate.

The driver converts an external power source to a driving current supplied to the light source.

In some embodiments, the driver is located at a peripheral area of the support plate and the light source is located at a central area of the support plate.

In some embodiments, the light source plate has a first plate and a second plate.

The light source is placed on the first plate and the driver is placed on the second plate.

The first plate is detachably plugged to the second plate.

In some embodiments, a wireless module is placed on the light source plate.

The wireless module and the driver are placed at two opposite sides of the light source plate.

In some embodiments, an antenna is placed on the inner wall. The antenna is electrically connected to the driver.

In some embodiments, the support plate has a install hole for inserting an external to be electrically connected to the driver.

In some embodiments, the external wire is plugged to a socket on the install hole.

In some embodiments, a heat dissipation strip is placed for guiding heat of the light source to the surface rim.

In some embodiments, the support plate has a concave groove for placing the light source plate.

In some embodiments, the support plate has an elastic clip for holding the light source plate when the light source plate is pressed to pass by the elastic clip.

In some embodiments, the concave groove has a same shape as the light source plate to align the light source to the bottom part of the inner wall.

In some embodiments, multiple installation holes are placed on the support plate to attach to a bracket on a ceiling.

In some embodiments, the peripheral edge of the support plate has a ladder ring structure.

In some embodiments, the inner wall has a reflective layer used for reflecting a light of the light source.

In some embodiments, the reflective layer is a surface of the inner wall of the surface rim.

In some embodiments, the driver is hidden by the inner wall in an opposite side with respect to the light source.

In some embodiments, the bottom part of the inner wall presses the light source plate to fix the light source plate to the support plate.

In some embodiments, the exterior edge of the exterior wall has a curled edge to wrap the peripheral edge of the support plate to fix the support plate to the surface rim.

In some embodiments, a light passing cover is buckled to the top part of the inner wall.

DETAILED DESCRIPTION

Figure 7:
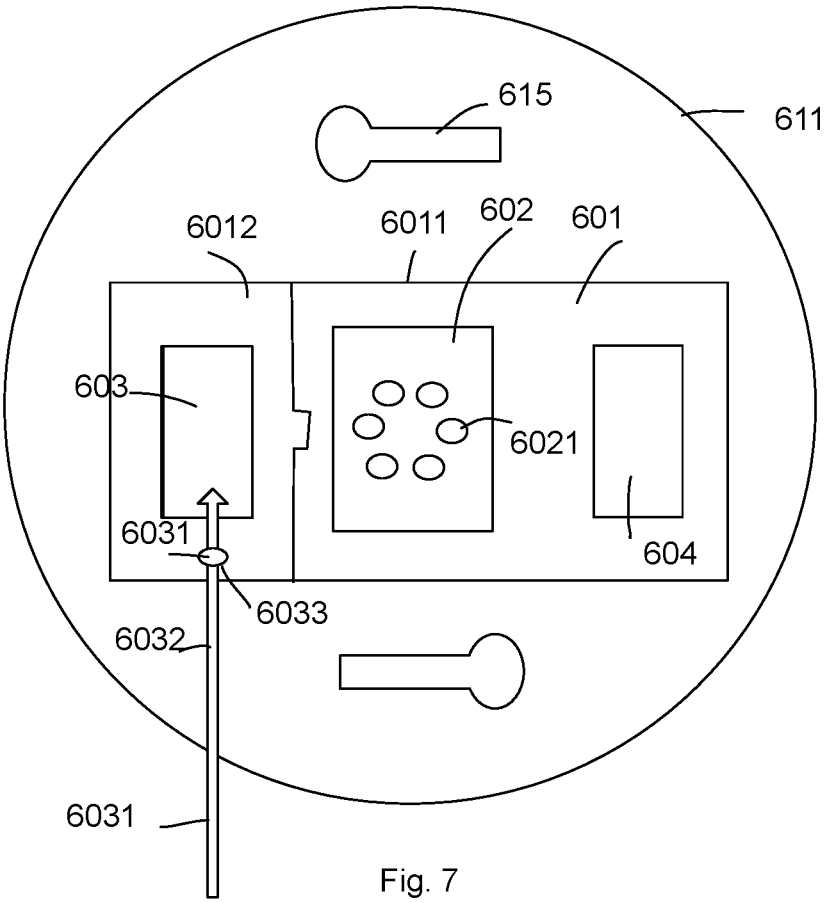
FIG. 7 illustrates another embodiment of a lighting apparatus.
Figure 8:
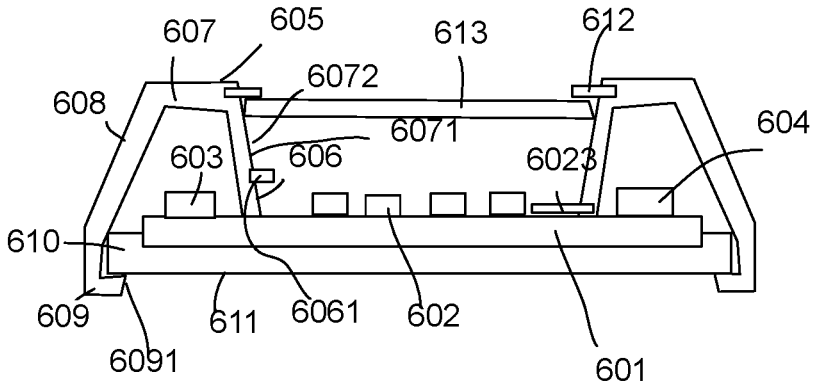
FIG. 8 shows a side view of the example in FIG. 7.

Please refer to FIG. 7 and FIG. 8, which illustrate an embodiment of a lighting apparatus and its side view showing component relation.

The lighting apparatus includes a light source plate 601, a support plate 611, a surface rim 607 and a light passing cover 613.

The light source plate 601 is mounted with a light source 602.

The light source plate 601 is placed upon the support plate 611.

The surface rim 607 has an inner wall 6071 and an exterior wall 608.

The inner wall 6071 has a top part 605 and a bottom part 606.

A bottom diameter of the bottom part 606 is smaller than a top diameter of the top part 605.

The light source is placed closer to the bottom part 606 of the inner wall 6071 and surrounded by the bottom part 606 of the inner wall 6071.

The light passing cover 613 is attached to the top part 605 of the inner wall 6071.

An exterior edge 609 of the exterior wall 608 is attached to a peripheral edge of the support plate.

In some embodiments, a driver 603 is also mounted on the light source plate 601.

The driver 603 converts an external power source 6031 to a driving current supplied to the light source 602. The light source 602 may contain multiple LED modules with different color temperatures to mix a desired color temperature controlled by the driver 603.

In some embodiments, the driver 603 is located at a peripheral area of the support plate 601 and the light source 602 is located at a central area of the support plate 611.

In some embodiments, the light source plate 601 has a first plate 6011 and a second plate 6012.

The light source 602 is placed on the first plate 6011 and the driver 603 is placed on the second plate 6012.

The first plate 6011 is detachably plugged to the second plate 6012. With such design, light devices with multiple required parameters may be achieved by replacing a proper driver on a second plate.

In some embodiments, a wireless module 604 is placed on the light source plate 601.

The wireless module 604 and the driver 603 are placed at two opposite sides of the light source plate 601. In some embodiments, the wireless module 604 has complicated processors that may be damaged when being placed too close to the driver 603 which usually generates lot of heat.

In some embodiments, an antenna 6061 is placed on the inner wall 606. The antenna 6061 is electrically connected to the driver 603. By placing the antenna 6061 on the inner wall 606, the antenna 6061 is not shielded by the inner wall 606 and provides a better signal quality, particularly when the surface rim is made of metal material.

In some embodiments, the support plate has a install hole 6031 for inserting an external wire 6032 to be electrically connected to the driver 603.

In some embodiments, the external wire 6032 is plugged to a socket 6033 on the install hole 6031.

In some embodiments, a heat dissipation strip 6023 is placed for guiding heat of the light source 602 to the surface rim 607.

In some embodiments, the support plate has a concave groove for placing the light source plate.

Figure 2:
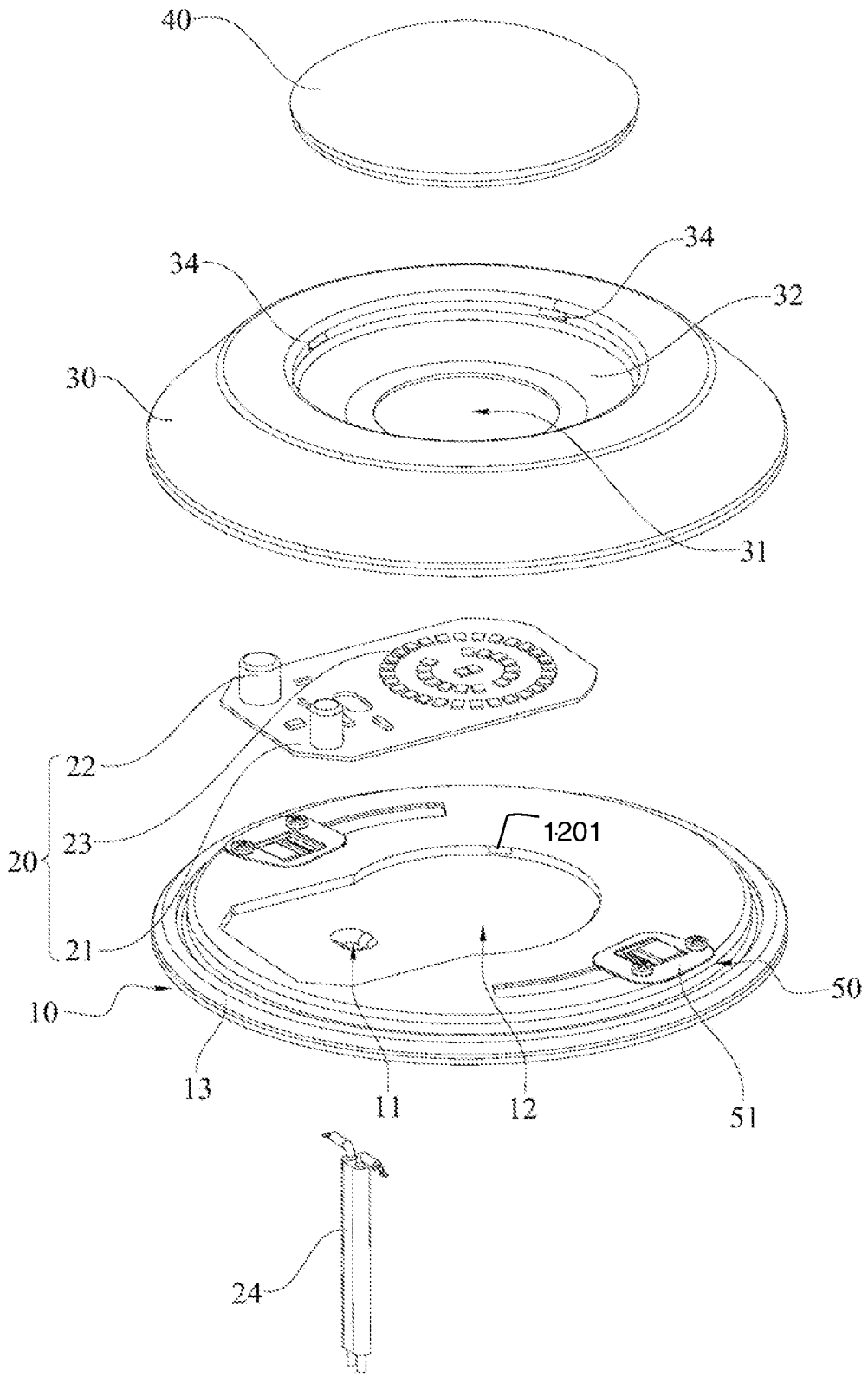
FIG. 2 illustrates an exploded view of the embodiment in FIG. 1.

Please refer to FIG. 2, there is a concave groove 12 with a similar shape as the light source plate 20. The light source plate 20 is placed in the concave groove 12 to align the light source 23 facing to a light opening 31.

In some embodiments, the support plate has an elastic clip 1201 for holding the light source plate 20 when the light source plate 20 is pressed to pass by the elastic clip 1201.

In some embodiments, the concave groove 12 has a same shape as the light source plate to align the light source to the bottom part of the inner wall.

In FIG. 7, multiple installation holes 615 are placed on the support plate 611 to attach to a bracket on a ceiling.

In FIG. 2, the peripheral edge of the support plate has a ladder ring structure 13, to increase the structure strength of the support plate.

In FIG. 8, the inner wall has a reflective layer 6072 used for reflecting a light of the light source 602.

In some embodiments, the reflective layer 6072 is a surface of the inner wall 6071 of the surface rim 607.

In some embodiments, the driver 603 is hidden by the inner wall 6071 in an opposite side with respect to the light source 602.

In some embodiments, the bottom part 606 of the inner wall 6071 presses the light source plate 601 to fix the light source plate to the support plate 611.

In some embodiments, the exterior edge 609 of the exterior wall 608 has a curled edge 6091 to wrap the peripheral edge 610 of the support plate to fix the support plate 611 to the surface rim 607.

In some embodiments, a light passing cover 613 is buckled to the top part 605 of the inner wall 6071 with an elastic clip 612.

Figure 1:
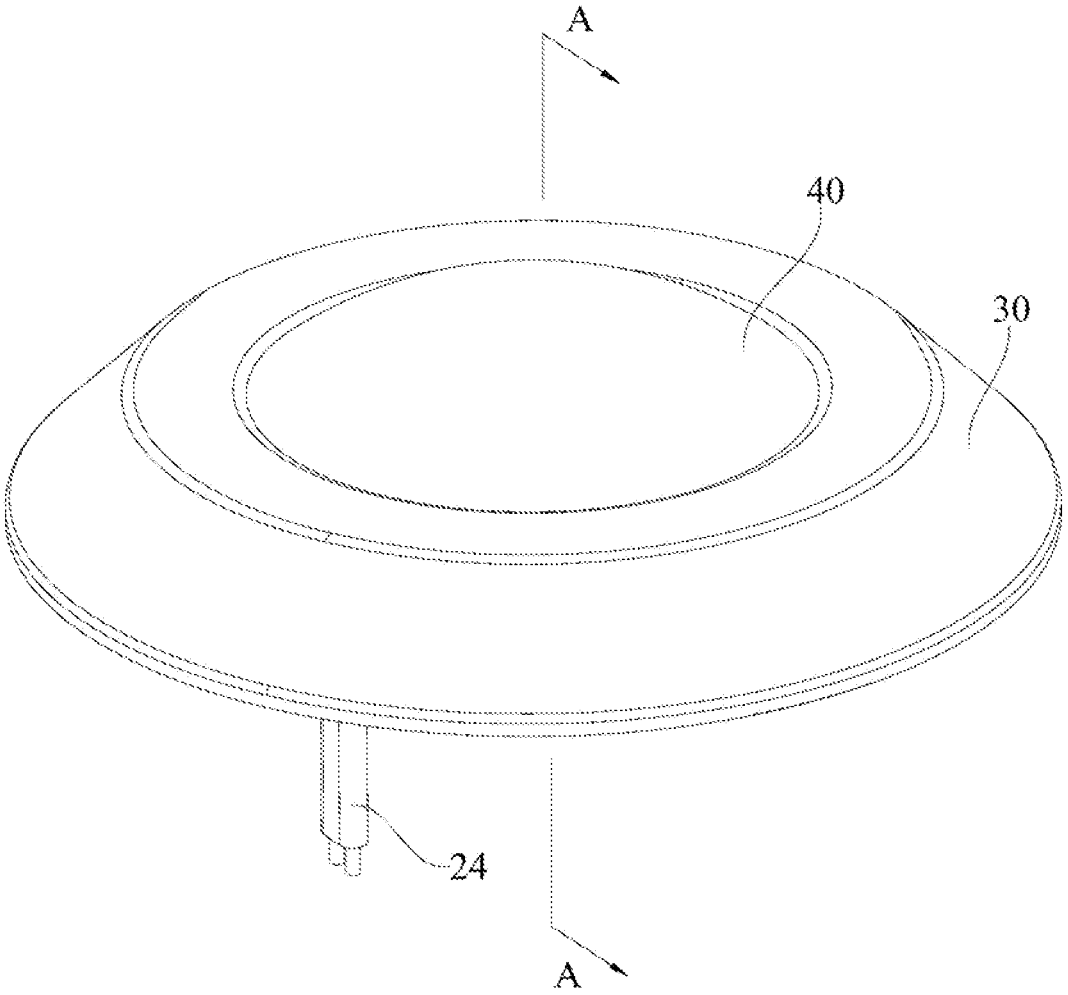
FIG. 1 illustrates a lighting apparatus embodiment.

Please refer to FIG. 1, which shows an embodiment of a lighting apparatus.

In FIG. 1, a light passing cover is fixed to a surface rim 30. There is an external wire 24 inserted to the lighting apparatus for providing an external power input.

Please refer to FIG. 2, which shows an exploded view of the example in FIG. 1.

In addition to the components mentioned above, the lighting apparatus further has an elastic clip 34 for holding the light passing cover 40 when the light passing cover 40 is pressed and passed by the elastic clip 34.

There is a light opening 31 on the surface rim 30 for allowing a light of the light source 23 of the light source plate 20 to pass through.

There is a driver 22 on the light source plate 20. The circuit board 21 is shared by the driver 22 and the light source 23 so that there is no need to add additional wires, to reduce complexity during assembly of the lighting apparatus.

The hole 11 is used for inserting the external wire 24.

The support plate 10 has a concave groove 12 for placing the light source plate 20.

There are multiple installation holes that may be added with fixing unit 50 like a fixing clip 51.

Figure 3:
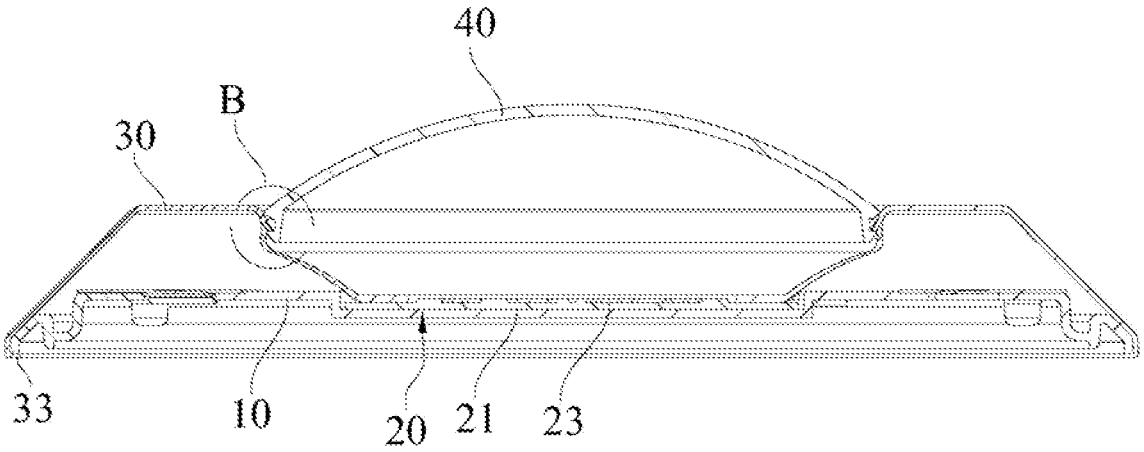
FIG. 3 illustrates a cross-sectional view of the example in FIG. 1.

Please refer to FIG. 3, which shows a side view of the example in FIG. 1 and FIG. 2.

In addition to the components mentioned above, the lighting apparatus has a curled edge on the surface rim 30 to hold and fix the support plate 10 to the surface rim 30.

Figure 4:
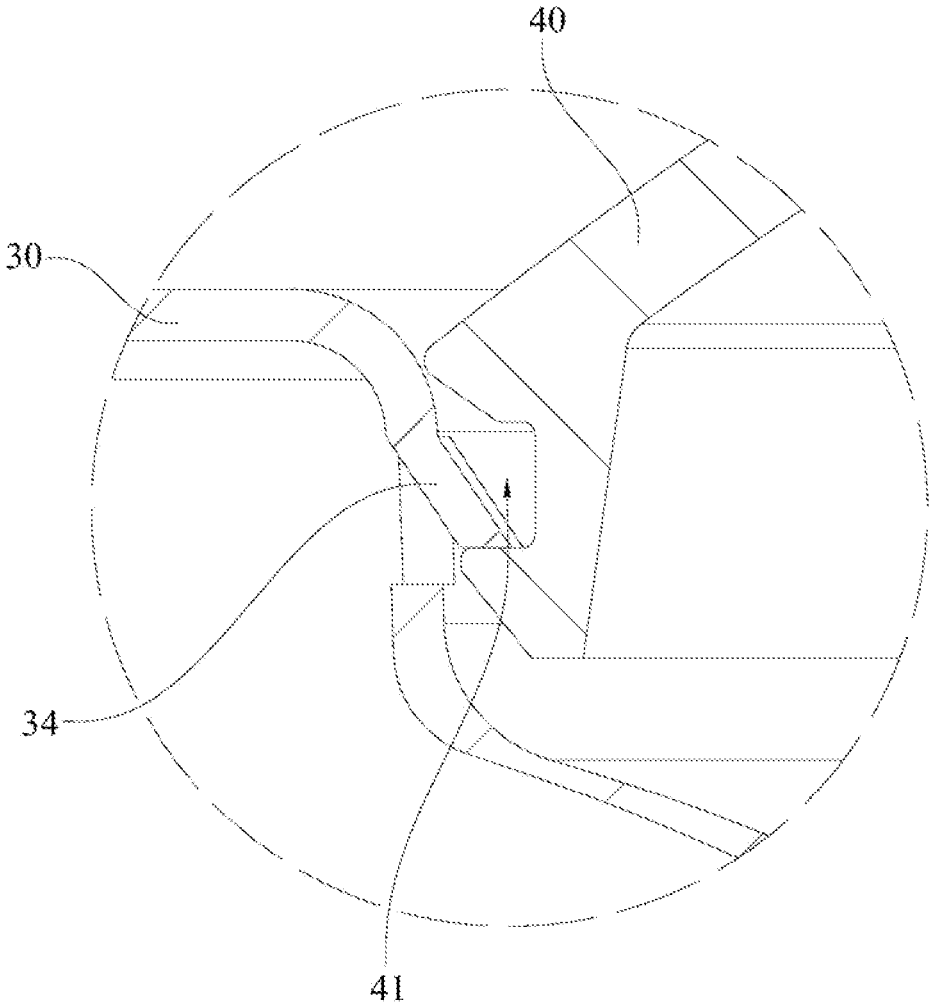
FIG. 4 illustrates a zoom-up view of a connection part.

FIG. 4 shows a lighting passing cover 40 mentioned above to be buckled by an elastic clip 34 of the surface rime with a corresponding groove structure 41.

Figure 5:
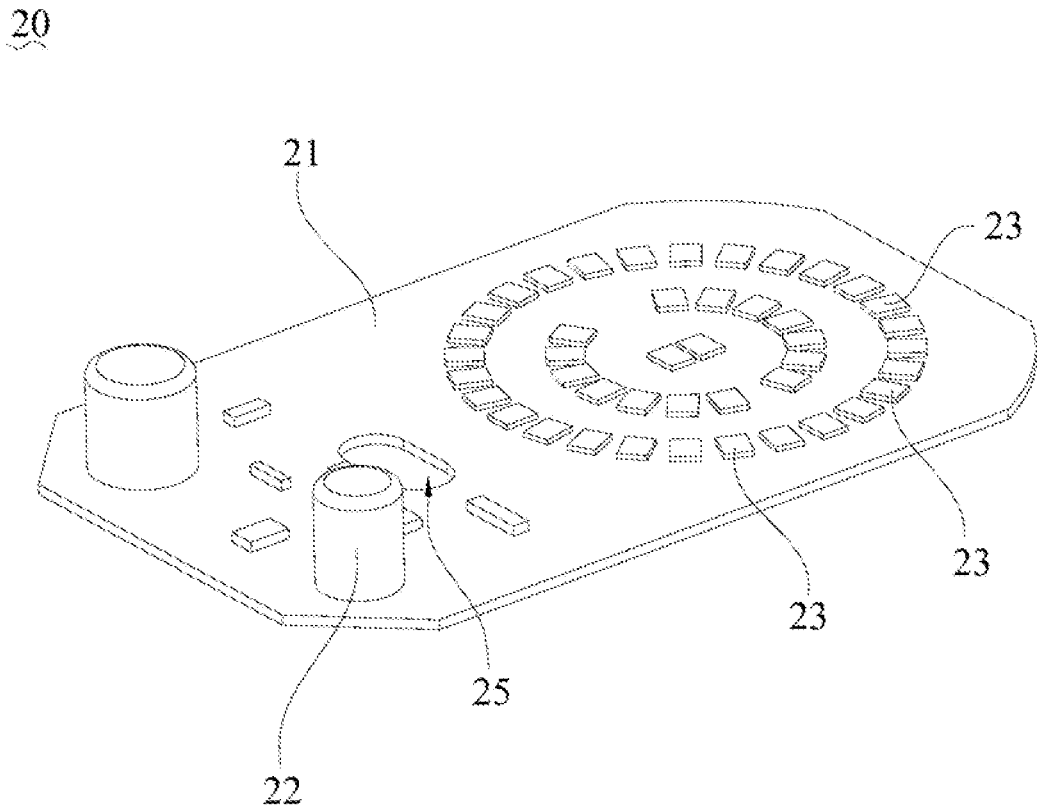
FIG. 5 illustrates a light source plate example.

Please refer to FIG. 5, which shows the example of a light source plate 20 that has a driver 22, a passing hole 25, a light source 23 on a circuit board 21.

Figure 6:
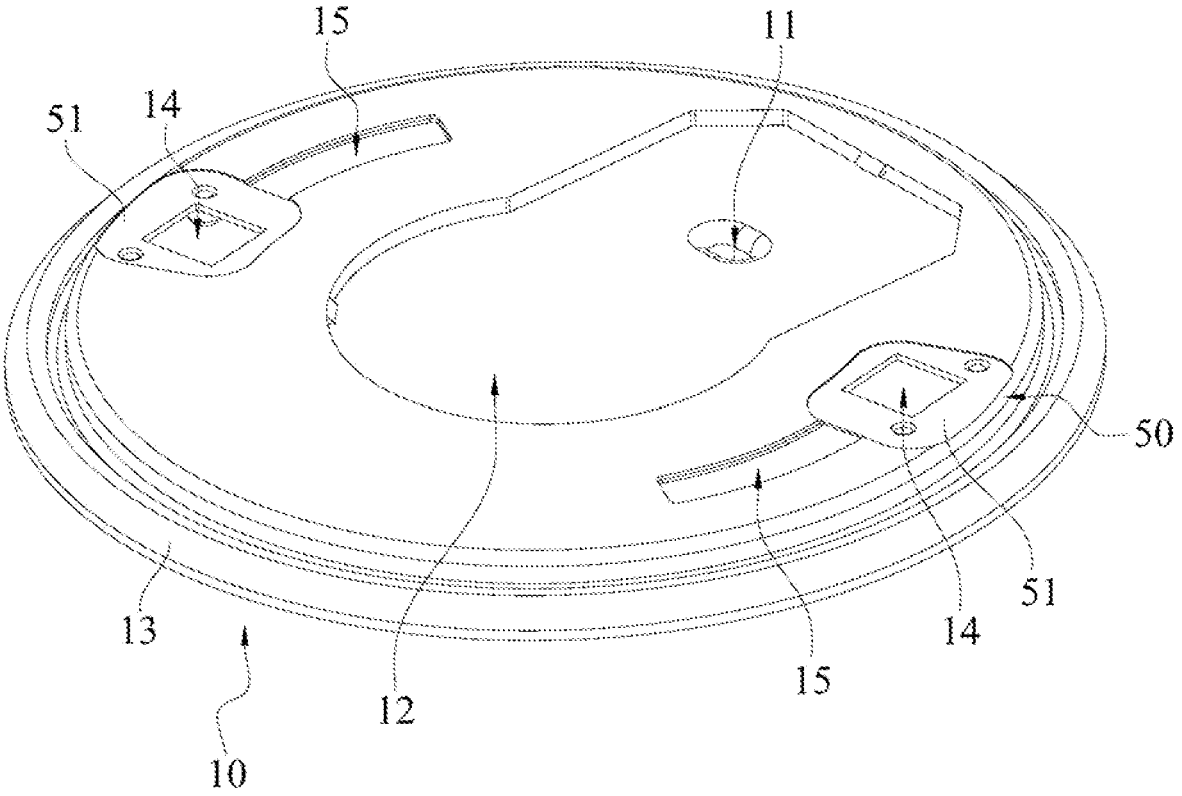
FIG. 6 illustrates a support plate example.

Please refer to FIG. 6, which shows a support plate example.

In FIG. 6, the support plate 10 has a ladder structure 13, a concave groove 12 and a passing hole 11 mentioned above.

The installation holes 14 may be corresponded to different standard fixing unit on a ceiling like the fixing unit 50.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source plate mounted with a light source;

a support plate, wherein light source plate is placed upon the support plate;

a surface rim having an inner wall and an exterior wall, wherein the inner wall has a top part and a bottom part, a bottom diameter of the bottom part is smaller than a top diameter of the top part, the light source is placed closer to the bottom part of the inner wall and surrounded by the bottom part of the inner wall; and a light passing cover attached to the top part of the inner wall, wherein an exterior edge of the exterior wall is attached to an peripheral edge of the support plate, wherein a driver is also mounted on the light source plate, the driver converts an external power source to a driving current supplied to the light source, wherein a wireless module is placed on the light source plate, the wireless module and the driver are placed at two opposite sides of the light source plate, wherein the light source is placed between the driver and the wireless module and the light source, wherein the light source, the driver and the wireless module are placed on a same plane of the light source plate.

2. The lighting apparatus of claim 1, wherein the driver is located at a peripheral area of the support plate and the light source is located at a central area of the support plate.

3. The lighting apparatus of claim 1, wherein the light source plate has a first plate and a second plate, the light source is placed on the first plate and the driver is placed on the second plate, the first plate is detachably plugged to the second plate.

4. The lighting apparatus of claim 1, wherein an antenna is placed on the inner wall, the antenna electrically connected to the driver.

5. The lighting apparatus of claim 1, wherein the support plate has an install hole for inserting an external wire to be electrically connected to the driver.

6. The lighting apparatus of claim 5, wherein the external wire is plugged to a socket on the install hole.

7. The lighting apparatus of claim 1, wherein a heat dissipation strip is placed for guiding heat of the light source to the surface rim.

8. The lighting apparatus of claim 1, wherein the support plate has a concave groove for placing the light source plate.

9. The lighting apparatus of claim 8, wherein the support plate has an elastic clip for holding the light source plate when the light source plate is pressed to pass by the elastic clip.

10. The lighting apparatus of claim 8, wherein the concave groove has a same shape as the light source plate to align the light source to the bottom part of the inner wall.

11. The lighting apparatus of claim 8, wherein multiple installation holes are placed on the support plate to attach to a bracket on a ceiling.

12. The lighting apparatus of claim 8, wherein the peripheral edge of the support plate has a ladder ring structure.

13. The lighting apparatus of claim 1, wherein the inner wall has a reflective layer used for reflecting a light of the light source.

14. The lighting apparatus of claim 13, wherein the reflective layer is a surface of the inner wall of the surface rim.

15. The lighting apparatus of claim 1, wherein the driver is hidden by the inner wall in an opposite side with respect to the light source.

16. The lighting apparatus of claim 15, wherein the bottom part of the inner wall presses the light source plate to fix the light source plate to the support plate.

17. The lighting apparatus of claim 1, wherein the exterior edge of the exterior wall has a curled edge to wrap the peripheral edge of the support plate to fix the support plate to the surface rim.

18. The lighting apparatus of claim 1, wherein a light passing cover is buckled to the top part of the inner wall.

* * * * *